US006006662A

United States Patent [19]

Ishida et al.

[11] Patent Number: 6,006,662

[45] Date of Patent: Dec. 28, 1999

[54] AUTOMATIC CONTROL APPARATUS IN PRINTING PRESS

[75] Inventors: Masaaki Ishida; Masaru Yamamoto, both of Ibaragi, Japan

[73] Assignee: Komori Corporation, Tokyo, Japan

[21] Appl. No.: 09/099,239

[22] Filed: Jun. 16, 1998

[30] Foreign Application Priority Data

Jun. 18, 1997 [JP] Japan ..... 9-161228

[51] Int. Cl.[6] ..... B41F 27/06

[52] U.S. Cl. ..... 101/141; 101/349.1; 101/477

[58] Field of Search ..... 101/216, 477, 101/141, 142, 483, 484, 485, 415.1, 355, 349.1, 423, 425, 136, 137, 183, 138, 143

[56] References Cited

U.S. PATENT DOCUMENTS

| | | | |
|---|---|---|---|
| 5,406,888 | 4/1995 | Sugiyama et al. | 101/415.1 |
| 5,454,317 | 10/1995 | Kobler et al. | 101/415.1 |
| 5,515,782 | 5/1996 | Ebina et al. | 101/424 |
| 5,701,822 | 12/1997 | Metrope | 101/477 |

FOREIGN PATENT DOCUMENTS

| | | |
|---|---|---|
| 141168 | 5/1985 | European Pat. Off. . |
| 726146 | 8/1996 | European Pat. Off. . |
| 763428 | 3/1997 | European Pat. Off. . |
| 2637071 | 2/1977 | Germany . |
| 29612 159 U | 8/1996 | Germany . |

*Primary Examiner*—J. Reed Fisher

*Attorney, Agent, or Firm*—Blakely Sokoloff Taylor & Zafman

[57] ABSTRACT

An automatic control apparatus in a printing press includes plate replacing units, an ink presetting portion, and a test printing control unit and a CPU. Each plate replacing unit mounts a printing plate on a circumferential surface of a plate cylinder. The ink presetting portion forms, in a roller group of an ink supply unit, an ink film thickness distribution corresponding to an image of the printing plate which is to be mounted on the plate cylinder. The test printing control unit and the CPU control the plate replacing units and the ink presetting portion to automatically perform, as a series of work steps, at least a mounting operation of mounting the printing plate on the plate cylinder and a forming operation of forming the ink film thickness distribution corresponding to the image of the printing plate.

9 Claims, 7 Drawing Sheets

AUTOMATIC CONTROL APPARATUS IN PRINTING PRESS

BACKGROUND OF THE INVENTION

The present invention relates to an automatic control apparatus in a printing press, which automatically mounts a printing plate on a plate cylinder and forms an ink film thickness distribution corresponding to the image of the printing plate, as a series of work steps.

FIG. 7 shows the schematic arrangement of an ink supply unit in each printing unit in a web offset printing press. Referring to FIG. 7, reference numeral 1 denotes an ink fountain. An ink 2 is stored in the ink fountain 1. An ink fountain roller 3 supplies the ink stored in the ink fountain 1. A plurality of ink fountain keys 4 are arranged parallel to each other in the axial direction of the ink fountain roller 3. Reference numeral 5 denotes an ink ductor roller; and 6, an ink roller group. The ink ductor roller 5 is arranged between the ink fountain roller 3 and the uppermost-stream roller of the ink roller group 6. A printing plate 7 is mounted on the circumferential surface of a plate cylinder 10. Reference numeral 8 denotes dampening water. A dampening roller group 9 supplies the dampening water 8 to the printing plate 7 mounted on the plate cylinder 10. A blanket cylinder 20 opposes to the plate cylinder 10.

In this ink supply unit, the ink 2 in the ink fountain 1 is supplied to the ink fountain roller 3 by adjusting the aperture pat of the ink fountain keys 4. The ink 2 supplied to the ink fountain roller 3 is supplied, by the ducting operation of the ink ductor roller 5, to the printing plate 7 mounted on the circumferential surface of the plate cylinder 10 through the ink roller group 6. Along with this ink supply operation, the dampening water 8 is supplied to the printing plate 7 through the dampening roller group 9.

When an old printing plate is replaced for a new printing plate 7, the aperture pat of the ink fountain keys 4, the rotation ratio of the ink fountain roller 3, the supply amount of the dampening water 8, and the like are preset in accordance with the image of the printing plate 7. More specifically, the aperture pat of the ink fountain keys 4, the rotation ratio of the ink fountain roller 3, the supply amount of the dampening water 8, and the like are set at values that match the image of the printing plate 7. Then, the ink 2 in the ink fountain 1 is supplied to the printing plate 7 through the ink roller group 6, and the dampening water 8 is supplied to the printing plate 7 through the dampening roller group 9. In this case, test printing is performed before final printing to adjust the ink supply amount, thereby obtaining a satisfactory color tone. Hence, a desired ink film thickness distribution (gradient of the ink film thickness) is formed in the ink roller group 6.

In a conventional ink supply unit, when the old printing plate is replaced for the new printing plate 7, an ink film thickness distribution corresponding to the old printing plate remains in the ink roller group 6. In this case, the ink film thickness distribution for the old printing plate must be gradually changed to that for the new printing plate 7, and ink supply amount adjusting operation and test printing operation must be excessively performed until a satisfactory color tone is obtained.

From the above reason, in order to decrease the number of times of adjustment of the ink supply amount and the number of times of test printing that are to be performed until a satisfactory color tone is obtained, the present applicant proposes "an ink film thickness control method" in U.S. Ser. No. 08/884,349.

According to this ink film thickness control method, in replacing an old printing plate for a new printing plate 7, the ink is removed. More specifically, the ducting operation of the ink ductor roller 5 is turned off, and the printing press is operated while the old printing plate is mounted, to perform printing by a predetermined number sheets. As a result, as shown in FIG. 8A, only a minimum ink film thickness distribution (to be referred to as the basic ink film thickness distribution hereinafter) Ma, which is required during printing, is left in the ink roller group 6 to decrease from the upstream to the downstream.

The blanket cylinder (not shown) is cleaned, the old printing plate is replaced for the new printing plate 7, and pre-inking II is performed. More specifically, the aperture pat of the ink fountain keys 4, the rotation ratio of the ink fountain roller 3, the supply amount of the dampening water 8, and the like are preset in accordance with the image of the new printing plate 7, and the printing press is operated. Hence, the ink ductor roller 5 is caused to perform the ducting operation a predetermined number of times, to superpose, on the basic ink film thickness distribution Ma left in the ink roller group 6, an ink film thickness distribution (to be referred to as the image ink film thickness distribution) Mb in accordance with the image of the new printing plate 7, as shown in FIG. 8B.

While the image ink film thickness distribution Mb is superposed on the basic ink film thickness distribution Ma, test printing is performed by the predetermined number of sheets, and the test-printed matter is subjected to density check. In this density check, if a satisfactory color tone is obtained, ink film thickness control by pre-inking II is ended, and the printing press is shifted to final printing. If no satisfactory color tone is obtained, the image ink film thickness distribution Mb is finely adjusted by pre-inking (+) or pre-inking (−), and test printing is performed again.

Regarding cleaning of the blanket cylinder after ink removing, a cylinder cleaning apparatus described in U.S. Pat. No. 5,515,782 (Reference 1) may be used. Regarding replacement of the printing plate after cleaning the blanket cylinder, a plate replacing apparatus described in U.S. Pat. No. 5,406,888 (Reference 2) may be used. With the cylinder cleaning apparatus of Reference 1, the cleaning web can be urged against the circumferential surface of the blanket cylinder by a single switch operation to clean the blanket cylinder automatically. With the plate replacing apparatus of Reference 2, if the new printing plate 7 is set in the plate replacing apparatus in advance, replacement from the old printing plate to a new printing plate 7 can be performed automatically with a single switch operation.

The work procedure required in this case is as follows. Ink removing is selected on the menu window, to form the basic ink film thickness distribution Ma in the ink roller group 6 by an ink removing operation. The blanket cylinder cleaning unit is actuated by a switch operation to clean the blanket cylinder. Thereafter, the plate replacing apparatus is actuated by a similar switch operation, to replace the old printing plate for the new printing plate 7. Subsequently, pre-inking II is selected on the menu window to perform the operation of pre-inking II.

When the ink roller group 6 does not have an ink, e.g., when the printing plate 7 is to be set on the plate cylinder 10 for the first time, the plate replacing apparatus is actuated by a switch operation to mount the printing plate 7 on the plate cylinder 10. Then, pre-inking I is selected on the menu window to perform the operation of pre-inking I.

In the operation of pre-inking I, the ink fountain keys 4 are set to a predetermined aperture pat (e.g., 50%) and the rotation ratio of the ink fountain roller 3 is set to a predetermined value (e.g., 50%). The printing press is operated to perform the ducting operation of the ink ductor roller 5 a predetermined number of times. The basic ink film thickness distribution Ma (FIG. 7A) is accordingly formed in the ink roller group 6. Thereafter, the aperture pat of the ink fountain keys 4 and the rotation ratio of the ink fountain roller 3 are set to values that match the image of the printing plate 7, and the ducting operation of the ink ductor roller 5 is performed a predetermined number of times. As a result, the image ink film thickness distribution Mb (FIG. 7B) is superposed on the basic ink film thickness distribution Ma formed in the ink roller group 6.

While the image ink film thickness distribution Mb is superposed on the basic ink film thickness distribution Ma, test printing is performed for a predetermined number of sheets, and the test-printed matter is subjected to density check. In this density check, if a satisfactory color tone is obtained, ink film thickness control by pre-inking I is ended, and the printing press is shifted to final printing. If no satisfactory color tone is obtained, the image ink film thickness distribution Mb is finely adjusted by pre-inking (+) or pre-inking (–) and test printing is performed again.

In the conventional method described above, to replace plate, the ink removing operation, the blanket cleaning operation, the plate replacing operation, and the operation of pre-inking II are performed as independent work steps. More specifically, after the ink removing operation is ended, the printing press is shifted to the blanket cleaning operation. After the blanket cleaning operation is ended, the printing press is shifted to the plate replacing operation. After the plate replacing operation is ended, the printing press is shifted to the operation of pre-inking II. The work is repeatedly performed by giving an instruction on the following step in accordance with the operator's judgment while checking the operation state of the previous step. Therefore, a large work load acts on the operator.

When a printing plate is to be mounted on the plate cylinder for the first time, a similar problem arises. More specifically, an instruction for mounting a printing plate on a plate cylinder is sent. After the mounting preparation of the printing plate onto the plate cylinder is ended, an instruction for a shift to the operation of pre-inking I is supplied. In this manner, the operation is performed by giving an instruction on the following step in accordance with the operator's judgment while checking the operation state of the previous step, and accordingly the work load on the operator is also large.

SUMMARY OF THE INVENTION

It is an object of the present invention to provide an automatic control apparatus in a printing press, in which the number of times of adjustment of the ink supply amount and the number of times of test printing that are to be performed until a satisfactory color tone is obtained can be decreased.

It is another object of the present invention to provide an automatic control apparatus in a printing press, which can make a shift to final printing without applying a large work load on the operator.

In order to achieve the above objects, according to the present invention, there is provided an automatic control apparatus in a printing press, comprising plate mounting means for mounting a printing plate on a circumferential surface of a plate cylinder, ink preset means for forming, in a roller group of an ink supply unit, an ink film thickness distribution corresponding to an image of the printing plate which is to be mounted on the plate cylinder, and control means for controlling the plate mounting means and the ink preset means to automatically perform, as a series of work steps, at least a mounting operation of mounting the printing plate on the plate cylinder and a forming operation of forming the ink film thickness distribution corresponding to the image of the printing plate.

DESCRIPTION OF THE PREFERRED EMBODIMENT

The present invention will be described in detail with reference to the accompanying drawings.

Figure 2:
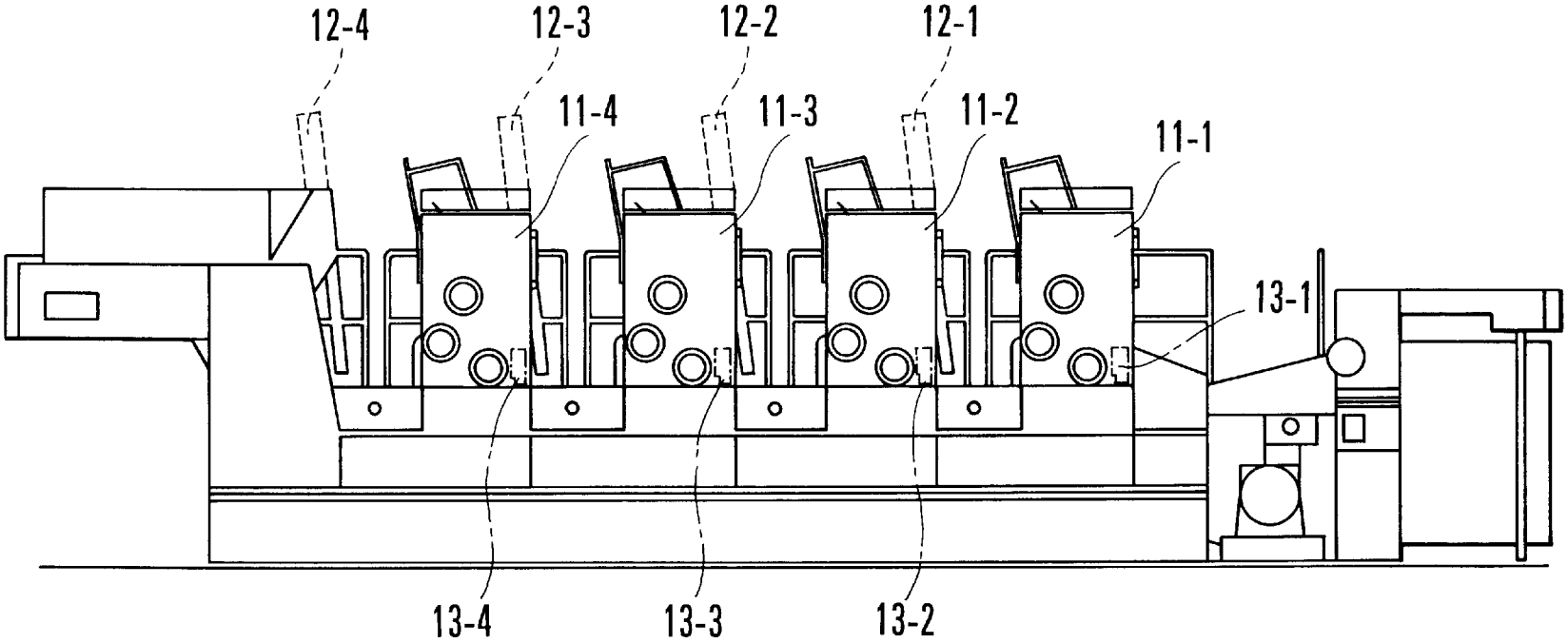
FIG. 2 is a side view of a four-color web offset printing press according to an embodiment of the present invention.
Figure 7:
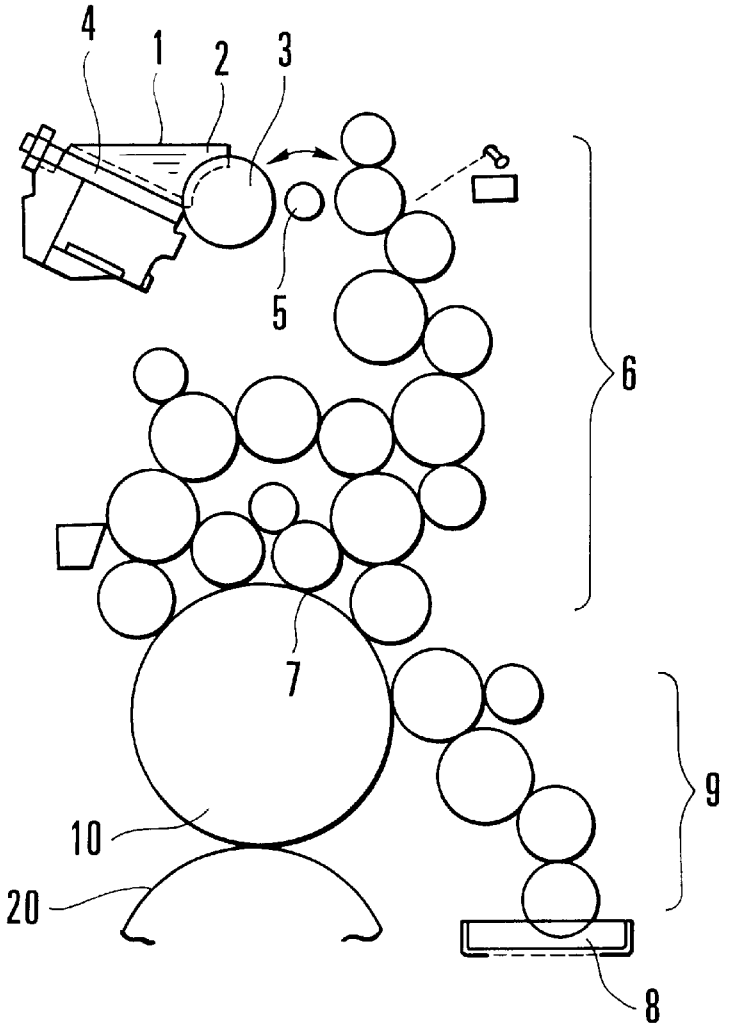
FIG. 7 is a diagram showing the schematic arrangement of an ink supply unit provided in each printing unit of a web offset printing press.
Figures 8A, 8B:
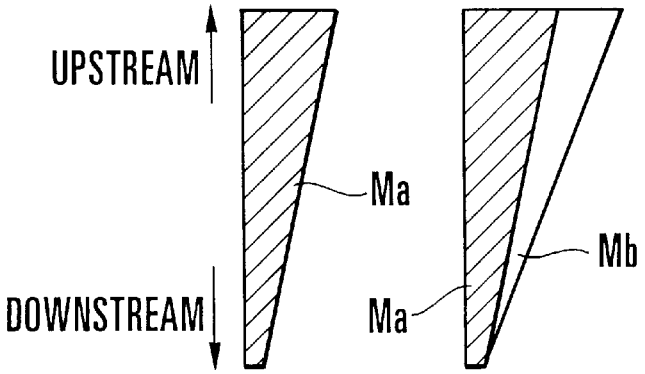
FIGS. 8A and 8B are views respectively showing a basic ink film thickness distribution Ma and an image ink film thickness distribution Mb formed in the ink roller group of the ink supply unit.

FIG. 2 shows a four-color web offset printing press according to an embodiment of the present invention. Referring to FIG. 2, reference numerals 11-1 to 11-4 denote printing units of four colors, respectively; and 12-1 to 12-4, plate replacing units identical to that described in Reference 1. The plate replacing units 12-1 to 12-4 are respectively arranged behind (downstream) the printing units 11-1 to 11-4. A corresponding one of blanket cylinder cleaning units (13-1 to 13-4) identical to that described in Reference 2, and the ink supply unit shown in FIG. 7 are arranged in each of the printing units 11-1 to 11-4.

Figure 3:
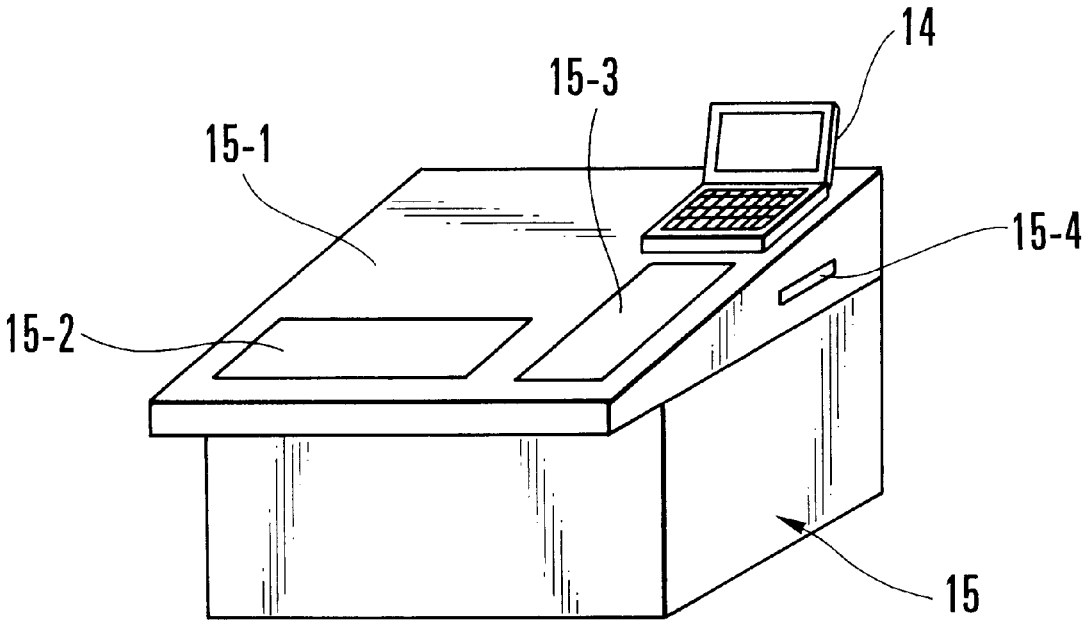
FIG. 3 is a perspective view of an operation desk provided to the four-color web offset printing press shown in FIG. 2.

This four-color web offset printing press has an operation desk 15, as shown in FIG. 3. The desktop of the operation desk 15 forms an operation panel 15-1. The operation panel 15-1 is constituted by an operation unit 15-2 and a display 15-3. A test printing control unit 14 comprising a personal computer is placed on the desktop of the operation desk 15.

Figure 4:
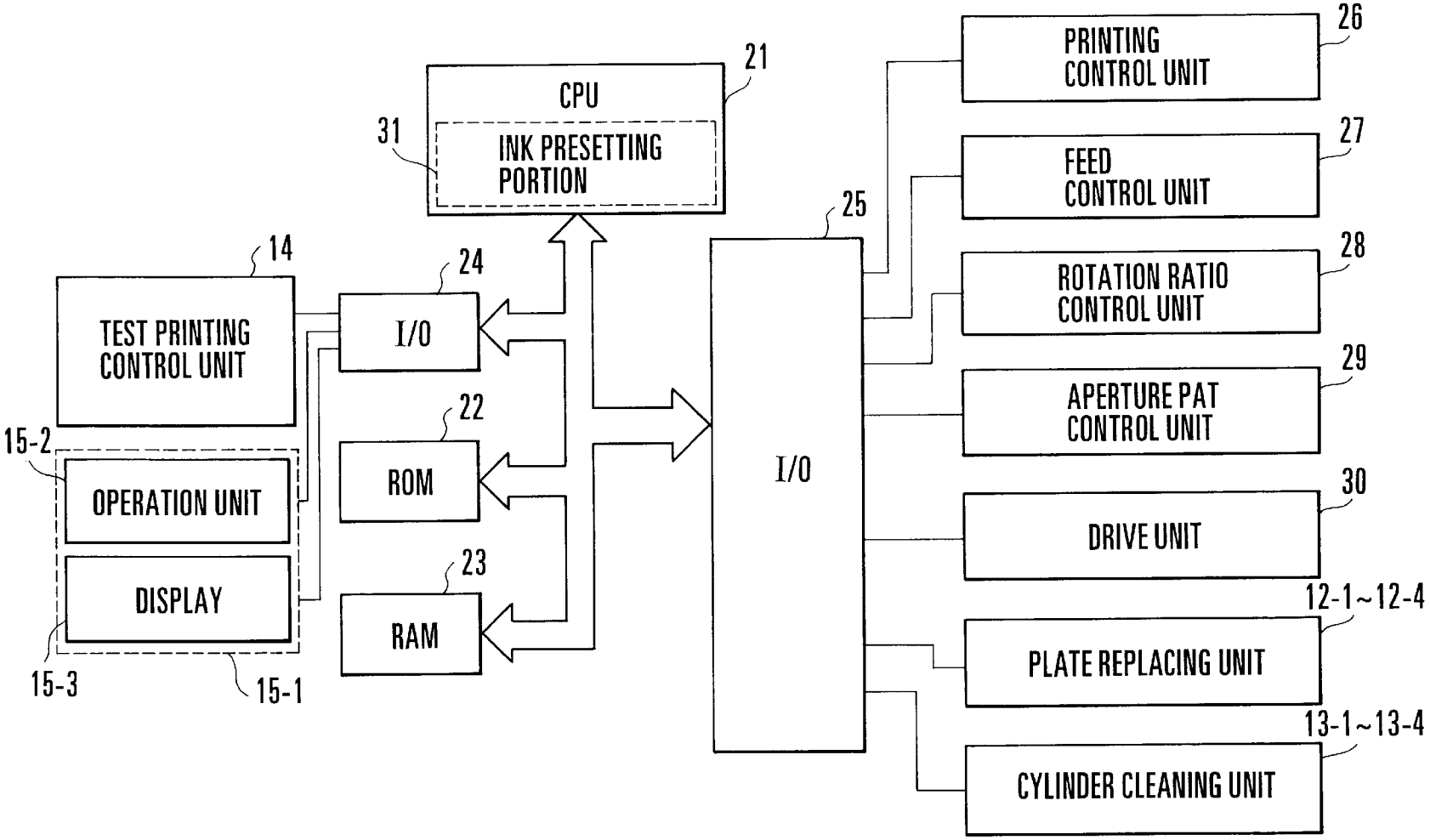
FIG. 4 is a block diagram showing the electrical arrangement of a printing press including a test printing control system.

FIG. 4 shows the electrical arrangement of a printing press including a test printing control system. Referring to FIG. 4, the printing press has a CPU (Central Processing Unit) 21, a ROM (Read Only Memory) 22, a RAM (Random Access Memory) 23, I/O interfaces 24 and 25, a printing control unit 26, a feed control unit 27, a rotation ratio control unit 28, an aperture pat control unit 29, and a drive unit 30. The CPU 21 performs various kinds of processing operations. Various kinds of programs, including those for ink supply and test printing, are stored in the ROM 22. Various kinds of data are stored in the RAM 23. The printing control unit 26 controls the printing press. The feed control unit 27 controls the on/off operation of a ducting mechanism that performs ink ducting. The rotation ratio control unit 28 controls the rotation ratio of the fountain roller. The aperture pat control unit 29 controls the aperture pat of the ink keys. The drive unit 30 drives a recording medium, e.g., a floppy disk. The test printing control unit 14 and the CPU 21 constitute the test printing control system. The test printing control system has, in the CPU 21, an ink presetting portion 31.

The I/O interface 24 is connected to the operation panel 15-2, the display 15-3, and the test printing control unit 14. The I/O interface 25 is connected to the printing control unit 26, the feed control unit 27, the rotation ratio control unit 28, the aperture pat control unit 29, the drive unit 30, the plate replacing units 12-1 to 12-4, and the blanket cylinder cleaning units 13-1 to 13-4. When the recording medium is a magnetic card, a card reader is connected, in place of the drive unit 30, to the I/O interface 25.

The CPU 21 receives various types of input information given through the I/O interfaces 24 and 25, and performs various kinds of processing operations, while accessing the RAM 23, in accordance with the programs stored in the ROM 22. The various kinds of processing information in the CPU 21 are supplied to the display 15-3, the test printing control unit 14, the printing control unit 26, the feed control unit 27, the rotation ratio control unit 28, the aperture pat control unit 29, the drive unit 30, the plate replacing units 12-1 to 12-4, and the blanket cylinder cleaning units 13-1 to 13-4 through the I/O interfaces 24 and 25.

Standardized test printing data is stored in the test printing control unit 14 or RAM 23 in advance. In this case, test printing data is preset conditions such as "the number of times of ink feed operations (the number of times of ink ducting operations), "the number of test printing sheets", "the number of sheets to be removed", "ink feed wait time", and the like in pre-inking I, ink removing, pre-inking II, pre-inking (+), and pre-inking (−).

A slot 15-4 of the drive unit 30, where a recording medium, e.g., a floppy disk or a magnetic card to be described later, is to be inserted is formed in the side surface of the operation panel 15-1. In this embodiment, final printing data created on the basis of the plate image area information is recorded on the recording medium. More specifically, preset value data such as the printing unit which is to use a given printing plate, and the aperture pat of the ink fountain keys, the rotation ratio of the ink fountain roller, the supply amount of the dampening water, and the like of this printing unit are recorded as final printing data in units of printing plates.

Figure 5B:
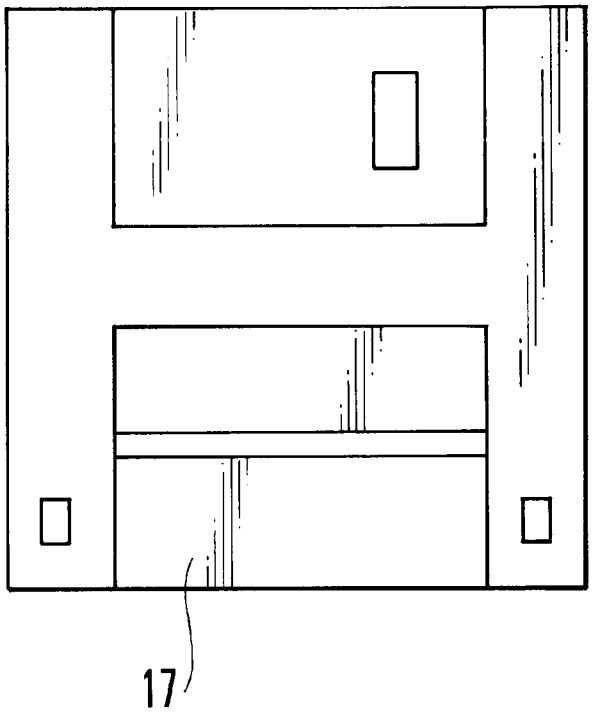
FIGS. 5A and 5B are views showing examples of a magnetic card and a floppy disk, respectively, as a recording medium.
Figure 5A:
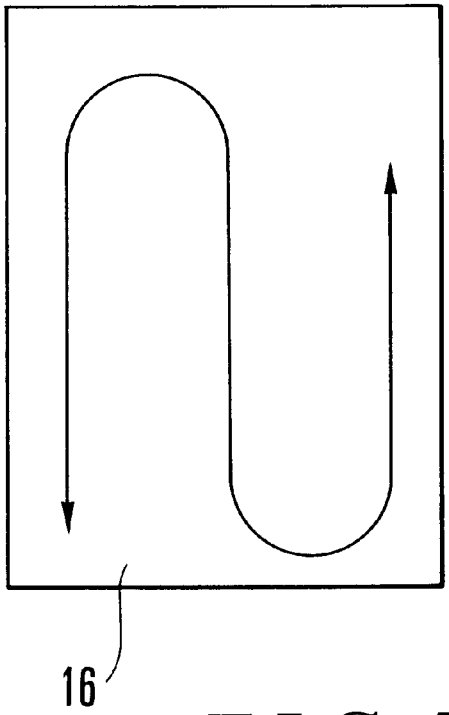

In the four-color web offset printing press having this arrangement, plate replacement in the printing units 11-1 to 11-4 is performed in the following manner. First, the operator inserts a recording medium, e.g., a magnetic card 16 shown in FIG. 5A or a floppy disk 17 shown in FIG. 5B on which final printing data is recorded in advance, in the drive unit 30 through the slot 15-4 of the operation panel 15-1.

Figure 6:
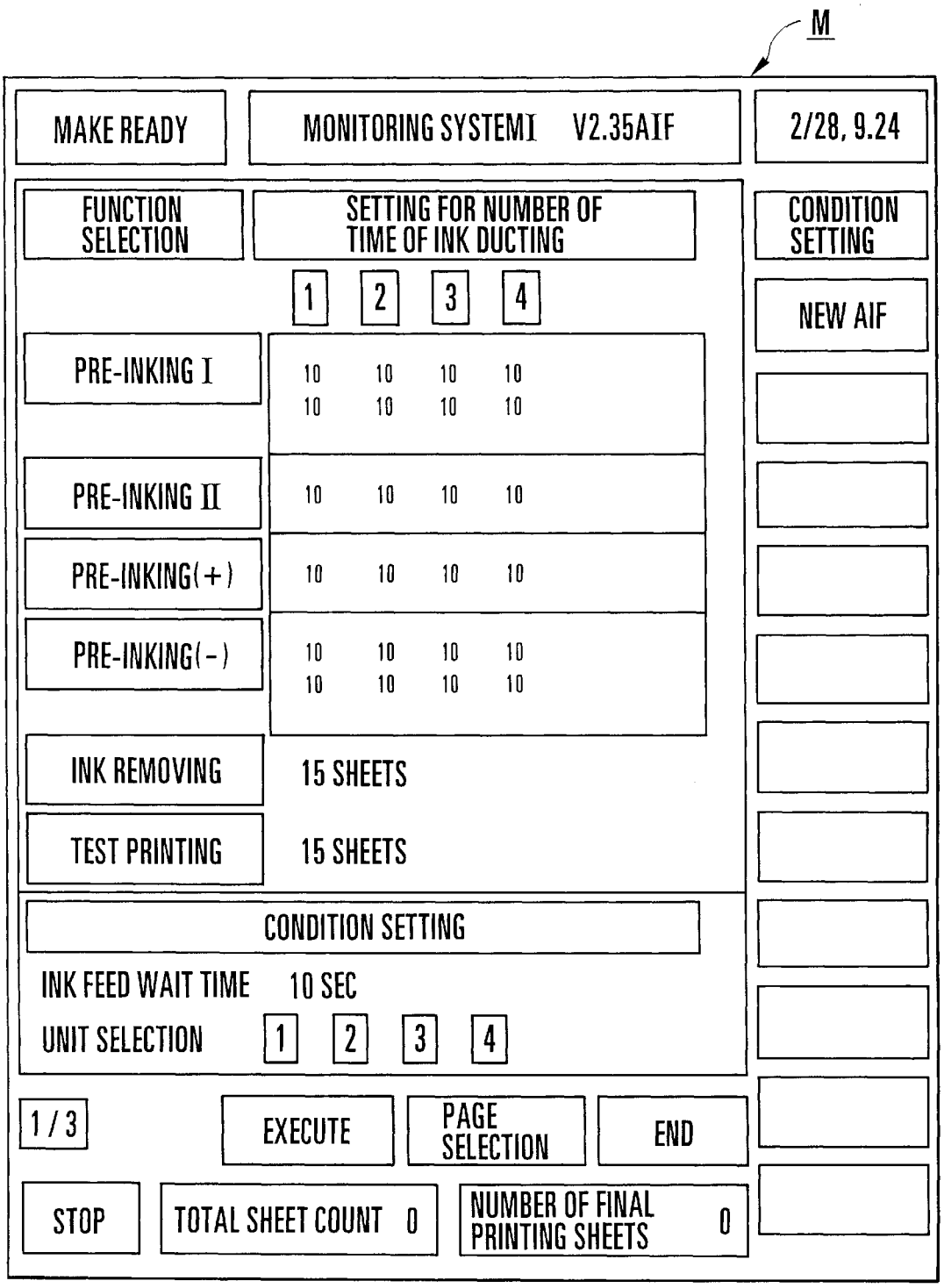
FIG. 6 is a view showing a menu window appearing on the display of the test printing control unit shown in FIG. 3.

The operator then let a menu window M as shown in FIG. 6 to appear on the display of the test printing control unit 14. On this menu window M, "pre-inking I", "pre-inking II", "pre-inking (+)", "pre-inking (−)", "ink removing", and "test printing" are displayed as functions that can be selected. Also, part of the test printing data which is standardized and stored in advance is displayed in the form of practical values.

More specifically, the number of times of ink ducting operations is displayed to correspond to each of displayed "pre-inking I", "pre-inking II", "pre-inking (+)", and "pre-inking (−)" in units of printing units 11-1 to 11-4. Also, the number of sheets to be printed in ink removing and the number of sheets to be test-printed are displayed to correspond to each of displayed "ink removing" and "test printing". The ink feed wait time is displayed to correspond to "ink feed wait time". Numbers "1" to "4" respectively corresponding to the printing units 11-1 to 11-4 are displayed to correspond to displayed "unit selection".

Operations necessary for performing total replacement of the printing plates (total replacement from old printing plates to new printing plates) in the printing units 11-1 to 11-4 by performing operations on the menu window M will be described with reference to the flow chart of FIG. 1. These operations are performed by the test printing control system constituted by the test printing control unit and the CPU 21.

The operator selects "pre-inking II" on the menu window M (step S101). In order to perform unit selection, all of numbers "1" to "4" corresponding to the printing units 11-1 to 11-4 are selected (step S102). If necessary, preset test printing data, e.g., the number of times of ink ducting operations in pre-inking II, the number of sheets to be printed in ink removing, the number of sheets to be test-printed, the ink feed wait time, and the like are changed.

When selection of the printing unit is ended, the test printing control system automatically presets the test printing data determined on the menu window M (step S103). Final printing data is read from the recording medium inserted in the slot 15-4 of the operation panel 15-1 (step S104). More specifically, for a printing plate to be mounted, preset data such as the printing unit which is to use this printing plate, the aperture pat of the ink fountain keys of this printing unit, the rotation ratio of the ink fountain roller, the supply amount of the dampening water, and the like are read.

The CPU 21 checks whether information on the printing units 11-1 to 11-4 (numbers "1" to "4") selected on the menu window M and information on the printing units read from the recording medium together with the final printing data completely coincide with each other (step S105). If there is one non-coincidence, if any, error display is made on the display 15-3 of the operation panel 15-1, and an alarm sound is generated to inform the operator of an erroneous operation (step S106). Thus, the operator knows an erroneous operation of the printing unit on the menu window M or an erroneous choice of the recording medium.

If all the selected printing units coincide with the read out information in step S105, whether the final printing data for all the printing units selected on the menu window M are correct is checked (step S107). More specifically, for the printing units 11-1 to 11-4 selected on the menu window M, whether the contents of the final printing data read from the recording medium are correct, i.e., whether all the data are included, is checked. If there is even one abnormal data, if any, error display indicating this error is made on the display 15-3 of the operation panel 15-1, and an alarm sound is generated to inform the operator of abnormal final printing data (step S108).

In step S107, if the final printing data are normal, whether new printing plates are set on all of the plate replacing units 12-1 to 12-4 of the printing units selected on the menu window M is checked (step S109). More specifically, for the printing units 11-1 to 11-4 selected on the menu window M, whether the new printing plates are set in their plate replacing units 12-1 to 12-4 is checked from an output from photoelectric sensors arranged at the new printing plate set positions of the plate replacing units 12-1 to 12-4. In this embodiment, the new printing plates are set in the plate replacing units 12-1 to 12-4 in advance during a free time before a plate replacing operation described with reference to FIG. 1 is started.

If a new printing plate is not set in one of the plate replacing units 12-1 to 12-4, if any, error display indicating this is made on the display 15-3 of the operation panel 15-1, and an alarm sound is generated to inform the operator of an erroneous operation (step S110). Thus, the operator notices an erroneous selection of a printing unit on the menu window M or an erroneous new printing plate setting operation for a plate replacing unit.

If YES in all of steps S105, S107, and S109, the operator turns on the start switch of the test printing control unit 14. When the start switch is turned on, the selected function designated by the operator in step S101 is checked (step S112). In this case, "pre-inking II" is selected, so that the ink presetting portion 31 performs an ink removing operation in units of printing units 11-1 to 11-4 (step S113). The ink removing operation has been described above. Hence, only the basic ink film thickness distribution Ma is left in the ink roller group 6 of each of the printing units 11-1 to 11-4.

After the ink removing operation is ended, the test printing control system actuates the blanket cylinder cleaning units respectively provided to the printing units 11-1 to 11-4, to clean the blanket cylinders in the printing units 11-1 to 11-4 (step S114). After cleaning of the blanket cylinders is ended, the test printing control system actuates the plate replacing units 12-1 to 12-4 to replace the old printing plates in the printing units 11-1 to 11-4 for new printing plates 7 (step S115).

After replacement of the old printing plates for the new printing plates 7 is ended, the ink presetting portion 31 performs the operation of pre-inking II in units of printing units 11-1 to 11-4 (step S116). The operation of pre-inking II has been described above. In the operation of pre-inking II, the final printing data read from the recording medium in step S104 is automatically preset. Hence, the image ink film thickness distribution Mb for the new printing plate 7 is superposed on the basic ink film thickness distribution Ma in the ink roller group 6 of each of the printing units 11-1 to 11-4.

While the image ink film thickness distribution Mb is superposed on the basic ink film thickness distribution Ma, the test printing control system performs test printing by a predetermined number of sheets. The operator checks the density of the test-printed matter. In this density check, if a satisfactory color tone is obtained, the ink presetting portion 31 ends ink film thickness control performed by pre-inking II, and shifts the printing press to final printing (step S119). If no satisfactory color tone is obtained, the image ink film thickness distribution Mb is finely adjusted by pre-inking (+) pr pre-inking (−), and test printing is performed again.

In the above operation, the old printing plate is replaced for the new printing plate in each of the printing units 11-1 to 11-4. If a printing plate is to be mounted on the plate cylinder for the first time in each of the printing units 11-1 to 11-4, i.e., if the ink roller group 6 of each of the printing units 11-1 to 11-4 does not have an ink, the operator selects pre-inking I in step S101. In this case, the flow advances to step S112 through steps S102 to S111 in the same manner as described above. Note that in step S112, "pre-inking I" is confirmed as the selected function designated by the operator.

If it is confirmed in step S112 that "pre-inking I" is selected, the test printing control system actuates the plate replacing units 12-1 to 12-4 to mount the printing plates in the printing units 11-1 to 11-4 (step S117). After the printing plates are mounted, the ink presetting portion 31 performs the operation of pre-inking I in units of printing units 11-1 to 11-4 (step S118).

The operation of pre-inking I has been described above. In the operation of pre-inking I, the final printing data read from the recording medium in step S104 is automatically preset. Hence, the basic ink film thickness distribution Ma is formed in the ink roller group 6 of each of the printing units 11-1 to 11-4, and thereafter the image ink film thickness distribution Mb is superposed on the basic ink film thickness distribution Ma.

While the image ink film thickness distribution Mb is superposed on the basic ink film thickness distribution Ma, the test printing control system performs test printing by a predetermined number of sheets. The operator checks the density of the test-printed matter. In this density check, if a satisfactory color tone is obtained, the ink presetting portion 31 ends ink film thickness control performed by pre-inking I, and shifts the printing press to final printing (step S119). If no satisfactory color tone is obtained, the image ink film thickness distribution Mb is finely adjusted by pre-inking (+) pr pre-inking (−), and test printing is performed again.

In the above description, a case wherein the printing plates are to be replaced, or to be set for the first time, in all of the printing units 11-1 to 11-4 has been explained. This also applies to a case wherein the above operations are to be performed for some of the printing units 11-1 to 11-4. For example, when the printing plate is to be replaced for only the printing unit 11-1, pre-inking II is selected in step S101, and the printing unit 11-1 is selected on the menu window M in step S102. Hence, plate replacement and formation of the ink film thickness distributions Ma and Mb are performed for only the printing unit 11-1.

When the old printing plates are to be replaced for the new printing plates 7, if each ink roller group 6 does not have an ink, i.e., when the ink film thickness distribution formed in each ink roller group 6 is to be entirely removed by blank sheet printing, the operator selects pre-inking I in step S101. In this case, the flow advances from step S112 to step S117. After the old printing plates are replaced for the new printing plates 7, the ink presetting portion 31 forms the ink film thickness distributions Ma and Mb by the operation of pre-inking I in step S118.

Figure 1:
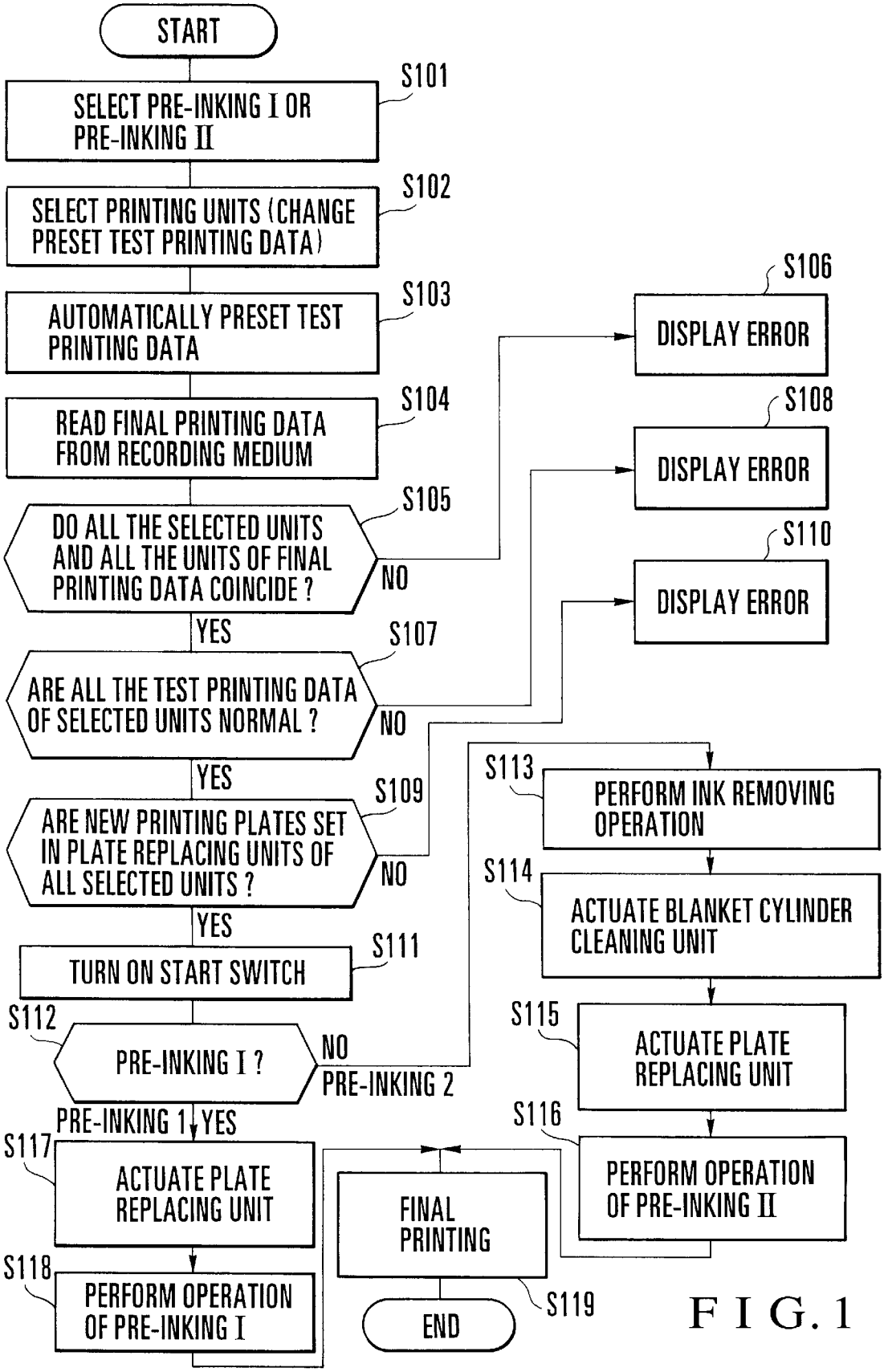
FIG. 1 is a flow chart for explaining an automatic control operation performed until final printing in a four-color web offset printing press shown in FIG. 2.

If the flow chart shown in FIG. 1 and the format of the menu window M shown in FIG. 6 are changed, the functions of the printing units 11-1 to 11-4 can be individually designated to perform the control operation. For example, pre-inking I may be designated for the printing unit 11-1 while pre-inking II may be designated for the printing unit 11-2. In this manner, the functions of the printing units 11-1 to 11-4 may be designated individually to perform the control operation.

In step S114, the blanket cylinder is cleaned because an ink corresponding to the image of the old printing plate is left on it. In this case, if the operation of pre-inking II is performed and test printing is performed without removing the remaining ink, normal test printing cannot be performed until the left ink corresponding to the image of the old printing plate is removed, which is time-consuming and causes a large amount of wasted paper.

As is apparent from the above description, according to this embodiment, when a printing plate is to be replaced, the cleaning operation of cleaning the blanket cylinder, the replacing operation of replacing the printing plate, and the forming operation of forming the ink film thickness distribution (ink removing and pre-inking II) are automatically performed as a series of work steps. As a result, the work load on the operator is decreased.

According to this embodiment, when a printing plate is to be set on the plate cylinder for the first time, the setting operation of setting the printing plate on the plate cylinder and the forming operation of forming an ink film thickness distribution (pre-inking I) are automatically performed as a series of work steps. As a result, the work load on the operator is decreased.

According to this embodiment, whether the printing units selected on the menu window M coincide with the printing units read from the recording medium together with final printing data, whether the new printing plates are set in the plate replacing units of the selected printing units, and whether the final printing data is normal are checked in steps S105, S107, and S109. Accordingly, a printing error that can be caused by an undesired state of these conditions can be prevented. As a result, the loss of work time can be decreased, the preparatory work time can be shortened, the productivity can be improved, and the amount of wasted paper can be decreased.

According to the above embodiment, the CPU 21 that performs the final printing operation cooperates with the test printing control unit 14 to perform the test printing operation including ink presetting. However, the test printing control unit 14 and the CPU 21 may separately perform the test printing operation and the final printing operation. Also, the test printing operation and the final printing operation may be performed by only the CPU 21.

As has been described above, according to the present invention, the cleaning operation of cleaning the blanket cylinder, the plate replacing operation, and the forming operation of forming the ink film thickness distribution (e.g., ink removing or pre-inking II) can be automatically performed as a series of work steps. Also, the setting operation of setting the printing plate on the plate cylinder, and the forming operation of forming an ink film thickness distribution (e.g., pre-inking I) can be automatically performed as a series of work steps. As a result, the number of times of adjustment of the ink supply amount and the number of times of test printing that are to be performed until a satisfactory color tone is obtained can be decreased, and the printing press can be shifted to final printing without imposing a large work load on the operator.

What is claimed is:

1. An automatic control apparatus in a printing press, comprising:

plate mounting means for mounting a printing plate on a circumferential surface of a plate cylinder;

ink preset means for forming, in a roller group of an ink supply unit, an ink film thickness distribution corresponding to an image of said printing plate which is to be mounted on said plate cylinder; and control means for controlling said plate mounting means and said ink preset means to automatically perform, as a series of work steps, at least a mounting operation of mounting said printing plate on said plate cylinder and a forming operation of forming the ink film thickness distribution corresponding to the image of said printing plate.

2. An apparatus according to claim 1, wherein the ink film thickness distribution is constituted by a minimum basic ink film thickness distribution which is required during printing and decreases from an upstream to a downstream, and an image ink film thickness distribution which corresponds to said image of the printing plate.

3. An apparatus according to claim 2, wherein, when said plate is to be mounted on said plate cylinder by said plate mounting means for the first time, said ink preset means forms the basic ink film thickness distribution in said roller group and thereafter superposes an image ink film thickness distribution on the basic ink film thickness distribution.

4. An apparatus according to claim 2, wherein said plate mounting means replaces an old printing plate mounted on said circumferential surface of said plate cylinder for a new printing plate, and when said old printing plate is replaced for said new printing plate by said plate mounting means, said ink preset means removes the image ink film thickness distribution corresponding to said old printing plate from said roller group to leave only the basic ink film thickness distribution, and thereafter superposes an image ink film thickness distribution corresponding to said new printing plate on the left basic ink film thickness distribution.

5. An apparatus according to claim 4, wherein said apparatus further comprises cylinder cleaning means for cleaning a circumferential surface of a cylinder which opposes to said plate cylinder, and said control means controls said plate mounting means, said ink preset means, and said cylinder cleaning means to automatically perform, as a series of work steps, a removing operation of removing the image ink film thickness distribution corresponding to said old printing plate, a cleaning operation of cleaning said circumferential surface of said cylinder, a replacing operation of replacing said old printing plate, mounted on said plate cylinder, for said new printing plate, and a forming operation of forming the image ink film thickness distribution corresponding to the image of said new printing plate on the basic ink film thickness distribution.

6. An apparatus according to claim 1, wherein said apparatus further comprises input means for selecting a printing unit having said plate cylinder and said plate mounting means, and storage means for storing final printing data in advance, and said control means performs, before the series of work steps, an error check on the basis of input data to said input means and final printing data which is read from said storage means in response to the input data, and performs error display when an error is detected.

7. An apparatus according to claim 1, wherein said control means performs test printing after an ink preset operation done by said ink preset means is ended, and performs final printing in response to an operator's input in accordance with a result of test printing.

8. An automatic control apparatus in a printing press, comprising:

plate mounting means for mounting a printing plate on a circumferential surface of a plate cylinder;

ink preset means for forming, in a roller group of an ink supply unit, an ink film thickness distribution corresponding to an image of said printing plate which is to be mounted on said plate cylinder, the ink film thickness distribution being constituted by a minimum basic ink film thickness distribution which is required during printing and decreases from an upstream to a downstream, and an image ink film thickness distribution which corresponds to the image of said printing plate; and control means for controlling said plate mounting means and said ink preset means to automatically perform, at least as a series of work steps, a mounting operation of mounting said printing plate on said plate cylinder and thereafter a forming operation of forming the basic ink film thickness distribution and the image ink film thickness distribution.

9. An automatic control apparatus in a printing press, comprising:

plate replacing means for replacing an old printing plate mounted on a circumferential surface of a plate cylinder for a new printing plate;

cylinder cleaning means for cleaning a circumferential surface of a cylinder which opposes to said plate cylinder;

ink preset means for forming, in a roller group of an ink supply unit, an ink film thickness distribution corresponding to an image of a new printing plate which is to be mounted on said plate cylinder, the ink film thickness distribution being constituted by a minimum basic ink film thickness distribution which is required during printing and decreases from an upstream to a downstream, and an image ink film thickness distribution which corresponds to the image of said printing plate; and control means for controlling said plate replacing means, said cylinder cleaning means, and said ink preset means to automatically perform, as a series of work steps, a removing operation of removing the image ink film thickness distribution corresponding to said old printing plate, a cleaning operation of cleaning said circumferential surface of said cylinder which opposes to said plate cylinder, a replacing operation of replacing said old printing plate, mounted on said plate cylinder, for said new printing plate, and a forming operation of forming the image ink film thickness distribution corresponding to an image of said new printing plate on the basic ink film thickness distribution.

* * * * *